US005106213A

United States Patent [19]

Martinez et al.

[11] Patent Number: 5,106,213

[45] Date of Patent: Apr. 21, 1992

[54] THERMAL PRINT HEAD CONTROL MECHANISM

[75] Inventors: Phillip M. Martinez, Dryden; Charles M. Curley, Ithaca, both of N.Y.

[73] Assignee: Smith Corona Corporation

[21] Appl. No.: 531,955

[22] Filed: Jun. 1, 1990

[51] Int. Cl.[5] ..... B41J 2/335

[52] U.S. Cl. ..... 400/120

[58] Field of Search ..... 400/120, 120 HE

[56] References Cited

U.S. PATENT DOCUMENTS

| | | | |
|---|---|---|---|
| 4,563,692 | 1/1986 | Negita et al. | 400/120 |
| 4,822,186 | 4/1989 | Hanaoka et al. | 400/120 |
| 4,844,632 | 7/1989 | Minowa | 400/120 |
| 4,913,567 | 4/1990 | Imamaki et al. | 400/120 |
| 4,962,392 | 10/1990 | Okuno et al. | 400/120 HE |

FOREIGN PATENT DOCUMENTS

| | | | |
|---|---|---|---|
| 0136268 | 8/1984 | Japan | 400/120 HE |
| 0092884 | 5/1985 | Japan | 400/120 HE |
| 0174176 | 7/1987 | Japan | 400/120 HE |

OTHER PUBLICATIONS

IBM, Technical Disclosure Bulletin, "Motor Drive Arrangement for Ribbon Feed . . . ", vol. 25, No. 11B, Apr. 1983.

*Primary Examiner*—Edgar S. Burr
*Assistant Examiner*—John S. Hilten

[57] ABSTRACT

A thermal print head control mechanism for use with a thermal typewriter or thermal printer supported on a carrier housing which moves along a platen and the mechanism includes a bidirectional motor and pinion gear for selectively rotating a sector gear about a center point. A bellcrank having a pair of arms is supported on the carrier housing for pivotal rotation about a point between the arms. An end of one of the arms carries a vertically directed print head proximate the platen and an end of the other arm is connected to an anchor near one side edge of the sector gear by a coil spring. The anchor point is positioned so that as the sector gear is rotated from one position to another, the longitudinal axis of the coil spring will cross over the sector gear center of rotation. During rotation of the sector gear, the axial length of the coil spring is such that it will be tensioned when its longitudinal axis is on each side of the sector gear center of rotation. In this manner the print head will bias against the platen and biased away therefrom as the gear is rotated. Additionally the mechanism is provided with abutments to limit the rotation of the sector gear and electrical controls for programmed gear rotation and for control of thermal print head printing.

15 Claims, 3 Drawing Sheets

THERMAL PRINT HEAD CONTROL MECHANISM

BACKGROUND OF THE INVENTION

1. Field of the Invention

The present invention relates generally to typewriters and printers and more particularly pertains to mechanisms for controlling the movement of thermal print heads for use in thermal typewriters and thermal printers.

2. Description of the Prior Art

Thermal printers and thermal typewriters have in the past included relatively complex structures to control the movement of the thermal print head toward and away from the platen and to apply a bias force for movement of the print head into engagement with the print medium or thermal ribbon which in turn engage the platen. Such control mechanisms have included coil springs and solenoids for providing biasing; and motors, solenoids, and electromagnets for overcoming such bias forces and releasing the thermal print head from contact with the recording medium.

Such structures are disclosed, for example, in U.S. Pat. Nos. 4,822,186, 4,844,632, 4,563,692 and 4,913,567. U.S. Pat. No. 4,822,186 discloses a complex mechanism employing a single reversible motor driving force coupled through a series of gears (transmitting means) for moving the thermal head to a non-printing position. The gears coact with a sector gear coupled to the print head for moving a lever against the bias force imposed by a coil spring. The reversibility of the motor enables movement of the thermal head between a printing and a non-printing position.

U.S. Pat. No. 4,844,632 discloses another complex mechanism which includes a biasing coil spring member which urges the print head against the platen by means of a transmission lever, a change lever and a pin, the latter of which engages a notch on the transmission lever. A print head release mechanism selectively relieves the spring bias force exerted on the print head and includes motor, a worm gear, a lever, an opening in the transmission lever and still a further spring means. There is also provided a mechanism for changing the level of bias force imposed on the print head.

The present invention discloses a typewriter or printer print head control mechanism for moving a print head from a print position proximate the platen to a non-printing position spaced from the platen. The control mechanism is mounted on a carrier housing which also includes a print head vertically supported by one arm of a bellcrank and whose other arm is coupled to a rotatable sector gear by a spring member A bi-directional stepper motor is coupled to the sector gear by a pinion gear for providing controlled rotary movement of the sector gear. The bellcrank is pivotable about a point proximate the intersection of its arms. The spring member is affixed to one end of the bellcrank arm and anchored to the sector gear proximate one of its side edges. The sector gear is rotatable about a center of rotation between the end of one of the bellcrank arms and the spring anchor, whereby upon rotation of the gear, the longitudinal axis of the coil spring member will cross over the sector gear center of rotation. When the coil spring longitudinal axis is on one side of the gear center of rotation, the spring is under tension and pivots the bellcrank to bias the print head against the platen. When the spring axis is on the other side of the gear center due to gear rotation, the spring is again under tension to pivot the bellcrank in the opposite direction to move the print head away from the platen. The mechanism further includes abutments for limiting the rotation of the sector gear.

SUMMARY OF THE INVENTION

The purpose of the present invention is to provide a thermal print head control mechanism for a thermal typewriter or a thermal printer that has all the advantages of similarly employed prior art mechanisms and is simpler in structure and requires fewer components, but yet provides for precise velocity control for the print head motion.

The present invention comprises a carrier housing on which is supported a rotatable sector gear to which is affixed one end of a coil spring. The other end of the spring is attached to one arm of a bellcrank. The opposite arm of the bellcrank carries a vertically oriented thermal print head. The bellcrank is supported for movement about a pivot located between the arms. The sector gear is rotated about a center point such that as the gear is rotated, the longitudinal axis of the coil spring will pass over the sector gear pivot point as the sector gear rotates between the limits of its rotation. The coil spring at rest is under tension at each end of the sector gear travel. In this manner the rotation of the sector gear causes lateral movement of the thermal print head toward and away from a platen supported proximate the thermal print head.

Accordingly it is an object of this invention to provide an improved thermal head control mechanism which moves a thermal print head rapidly and efficiently into and out of biasing engagement with a thermal ribbon or other print medium.

Another object of this invention is to provide a low cost, reliable thermal print head control mechanism which includes a minimum number of components arranged for efficient interaction as well as operation.

A still further object is to provide a print head control in which the same element (coil spring) functions to bias the print head against the platen and also to bias the print head away from the platen.

Another object of the invention is to provide spring means to bias the print head against the platen and to bias the print head away from the platen to require a stopper motor to be energized only for short periods of time in each direction of rotation to prevent heat build-up by the motor.

Other objects and many of the attendant advantages of this invention will be readily appreciated as the same becomes better understood by reference to the following detailed description when considered in connection with the accompanying drawings in which like reference numerals designate like parts throughout the figures thereof.

DETAILED DESCRIPTION OF THE PREFERRED EMBODIMENT

Figure 1:
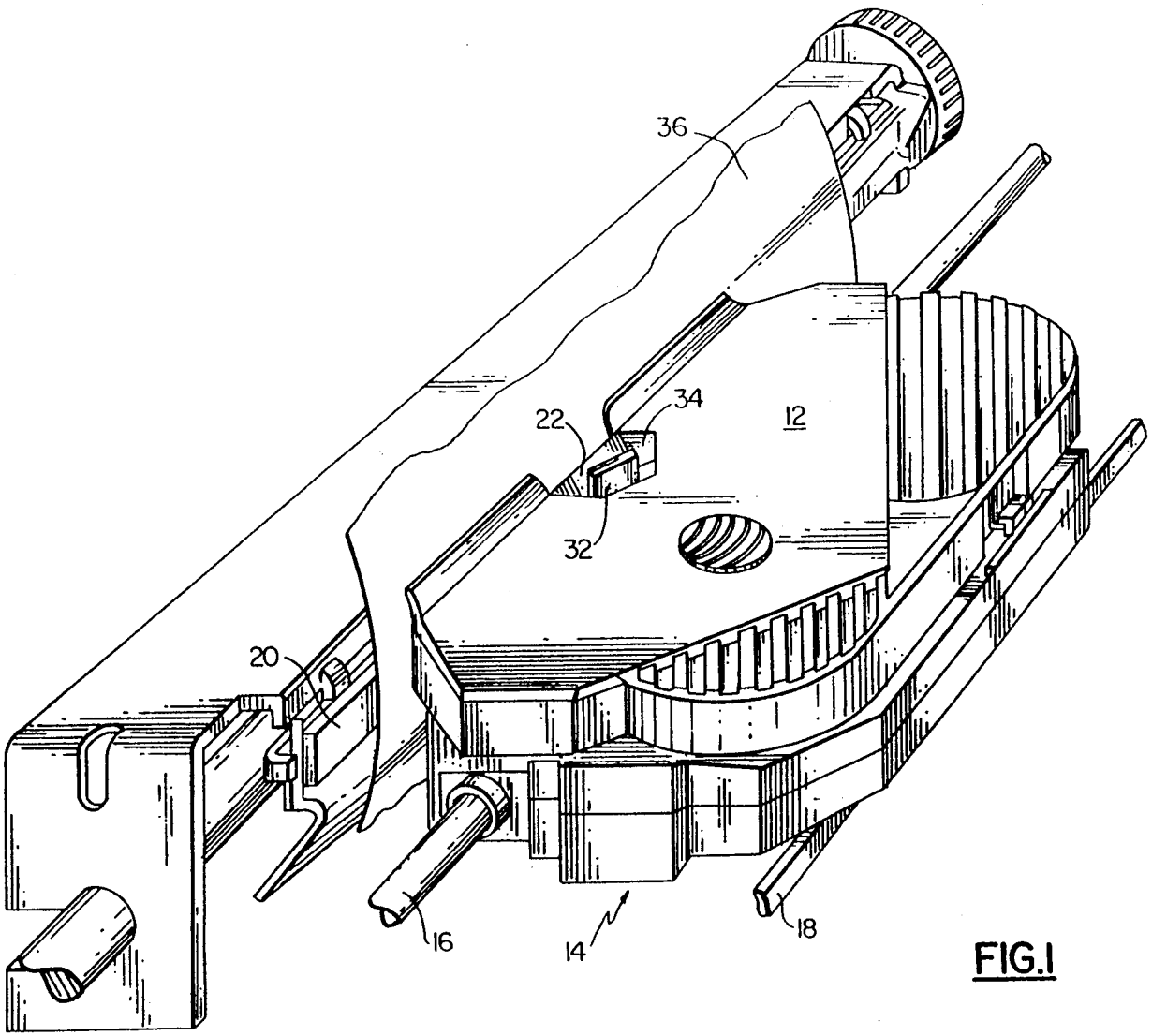
FIG. 1 is a left, front perspective view of a printing portion of a thermal printer and a ribbon cartridge for use therewith.

In the illustrated embodiment of FIG. 1 a thermal ribbon cartridge 12 is shown horizontally supported within a typewriter or printer on a movable carrier housing 14 for lateral movement on guide rail 16 and a support rail 18 along a platen 20 The cartridge 12 is releasably affixed to the housing 14 so that it may be removed when all the ribbon in the cartridge 12 is used. Also, a thermal ribbon 22 contained in the cartridge 12 is not necessary when the print medium is thermal sensitive paper. Disposed in the carrier housing 14 is a thermal print head control mechanism 30 (to be hereafter described) which includes a print head 32 that extends upwardly through the opening 34 in the cartridge 12. A paper 36 or other medium on which the printing is to occur is guided between the platen 20 and the ribbon 22 with the thermal print head 32 disposed on the opposite side of the ribbon 22. Where the print medium is thermal sensitive, the print head 32 directly contacts the medium without any intervening ribbon.

Figure 2:
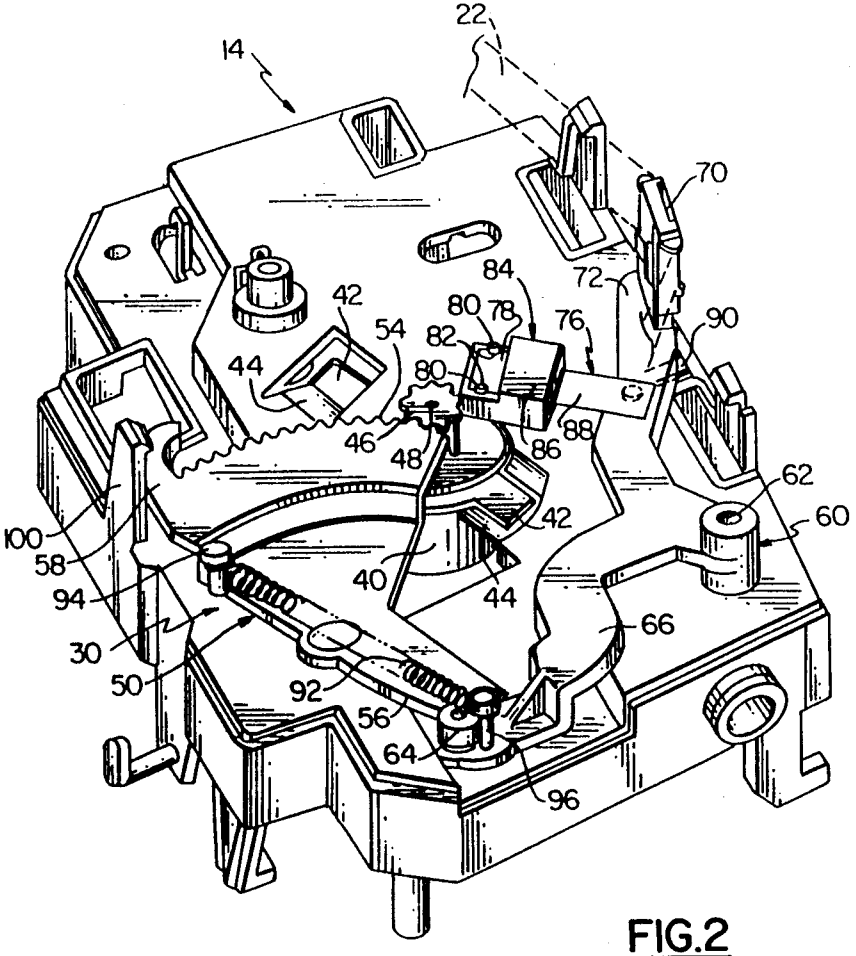
FIG. 2 is a right, front perspective view of the thermal print head control mechanism constructed in accordance with the present invention with the print head biased against the platen.

Referring now to FIG. 2, the print head control mechanism 30 is shown with the cartridge 12 and the upper portion of the housing 14 removed. The control mechanism 30 includes a stepper motor 40 mounted on the housing 14 by a pair of motor tabs 42 seated on a pair of arms 44 integrally extending from the housing 14. The arms 44 hold the motor 40 upwardly against the underside of the housing 14. A pinion gear 46 is mounted on a motor shaft 48 for rotation therewith.

Figure 5:
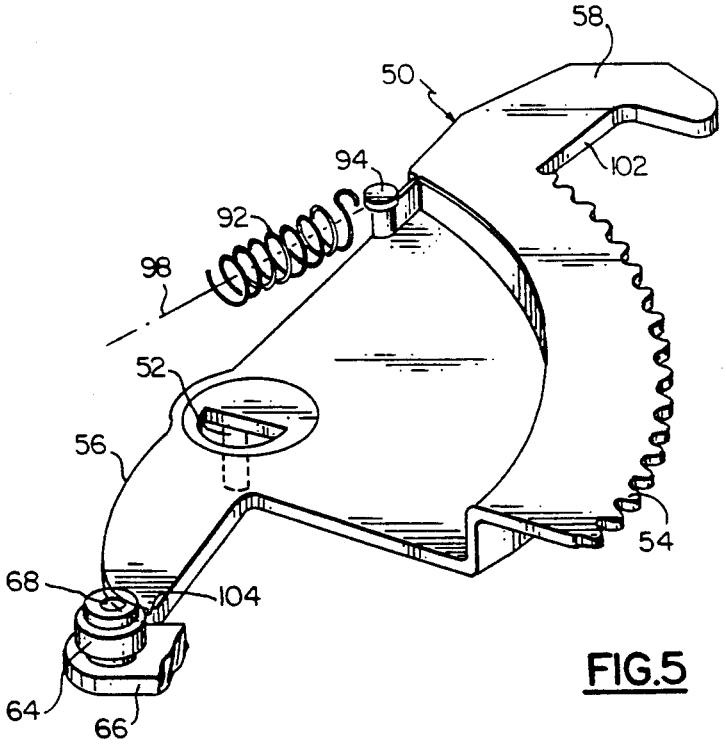
FIG. 5 is a perspective view of the sector gear.

Referring to FIGS. 2 and 5, a sector gear 50 is pivotably mounted on the housing 14 by a post 52 (FIG.5) integrally formed from the sector gear 50. The sector gear 50 has integrally formed teeth 54 in mesh with the pinion gear 46. A cam 56 and a finger 58 are integrally formed from the sector gear 50.

A bellcrank 60 is pivotably mounted on the housing 14 on a post 62 integrally projecting upwardly from the housing 14. A roller 64 is rotatably mounted on a first arm 66 of the bellcrank 60 on a post 68 integrally formed from the first arm 66. The thermal print head 70 is mounted on a second arm 72 of the bellcrank 60. The print head 70 has a single row of dots arranged vertically. The dots are heated electronically for thermal printing.

A circular abutment 74 integrally projects upwardly from the second arm 72. A leaf spring 76 is assembled to the housing 14 at a first end 78 by a pair of pins 80 seated in a pair of corresponding notches 82 in the leaf spring 76 and by a spring mounting 84. The spring mounting 84 is integrally formed from the housing 14. The pair of pins 80 are integrally formed from the spring mounting 84. A top portion 86 of the spring mounting 84 holds the first end 78 of the leaf spring 76 engaged with the pins 80 and holds a second end 88 of the leaf spring 76 against the abutment 74. The second end 88 of the leaf spring 76 biases the second arm 72 of the bellcrank 60 against a ridge 90 (shown best in FIG. 4) integrally projecting upwardly from the housing 14. This arrangement prevents the second arm 72 and the attached thermal print head 70 from moving vertically during printing which produces a required straight line of printing to form characters, numerals or other shapes.

Figure 3:
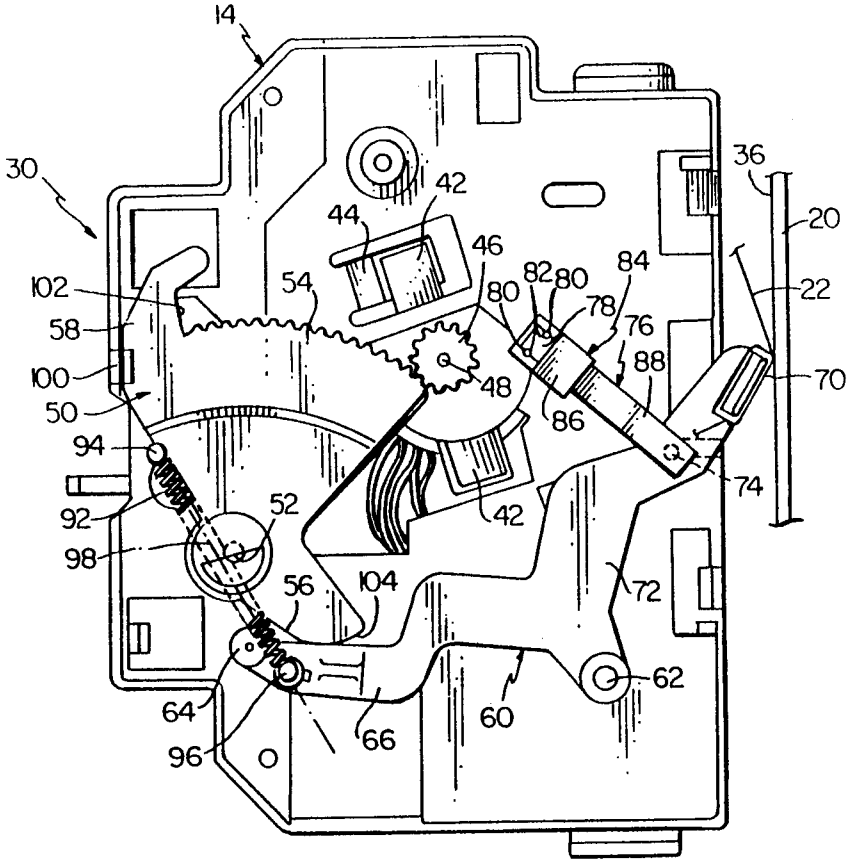
FIG. 3 is a top plan view of the thermal print head control mechanism with the print head biased against the platen.

A spring 92 is connected to the sector gear 50 at a spring anchor 94 integrally formed from the sector gear 50 and is connected to the first arm 66 of the bellcrank 60 at a spring anchor 96 integrally formed from the first arm 66. Referring to FIGS. 2 and 3, a longitudinal axis 98 of the spring 92 is on one side of the post 52 of the sector gear 50. In this position, the spring 92 biases the print head 70 clockwise about the post 62 in a print position against the paper 36 with a required force for thermal printing. Also in this position, the spring 92 biases the sector gear 50 counterclockwise to a limited position determined by the finger 58 abutting against a stop 100 integrally formed from the housing 14.

Figure 4:
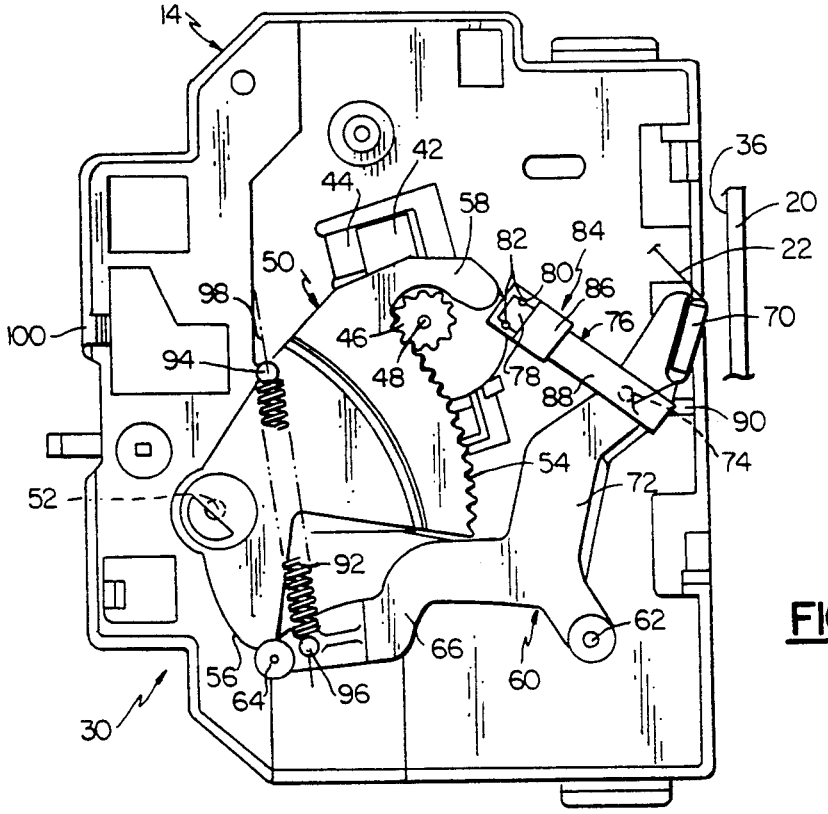
FIG. 4 is a top plan view of the thermal print head control mechanism with the print head biased away from the platen.

When the print head 70 needs to be moved from a print position (FIGS. 2 and 3) to a non-print position (FIG. 4) for paper insertion, carrier return and other purposes, the motor 40 is energized to rotate the pinion gear 46 counterclockwise. The sector gear 50 is rotated clockwise about the post 52 by the pinion gear 46 a sufficient amount to move the spring 92 to the right to cross the longitudinal axis 98 of the spring 92 over the pivot post 52 of the sector gear 50. The motor 40 is then de-energized. The spring 92 continues to rotate the sector gear 50 clockwise until an edge 102 (FIG. 5) of the finger 58 abuts against the pinion gear 46. The clockwise rotation of the sector gear 50 causes the cam 56 of the sector gear 50 to drive the roller 64 to pivot the bellcrank 60 counterclockwise about the post 62 to locate the print head 70 in a non-print position. When the print head 70 is located in a non-print position, the roller 64 is located on a dwell surface 104 of the cam 56 (FIGS. 4 and 5). The dwell surface 104 limits the amount of space between the print head 70 and the paper 36 when the print head 70 is located in a non-print position.

To return the print head 70 to the print position (FIGS. 2 and 3), the motor 40 is energized to rotate the pinion gear 46 clockwise initially at a fast rate and thereafter at a decelerating rate. The sector gear 50 is rotated counterclockwise about the post 52 by the pinion gear 46 a sufficient amount to move the spring 92 to the left to cross the longitudinal axis 98 of the spring 92 over the pivot post 52 of the sector gear 50. The motor 40 is then de-energized. The spring 92 continues to rotate the sector gear 50 counterclockwise until the finger 58 abuts against the stop 100.

During the counterclockwise movement of the sector gear 50, the spring 92 causes the roller 64 to follow the cam 56 of the sector gear 50 toward the pivot post 52. The shape of the cam 56 allows the spring 92 to bias the bellcrank 60 clockwise about the post 62 to bias the print head 70 against the paper 36 which is firmly supported by the bar shaped platen 20. Referring to FIG. 3, when the sector gear 50 is biased against the stop 100 and the print head 70 is biased against the paper 36, the roller 64 is slightly spaced away from the cam 56. Under this condition, the required force for efficient thermal printing is provided by the spring 92.

By having the spring 92 bias the sector gear 50 against the pinion gear 46 and against the stop 100, the motor 40 was energized only for short periods of time in each direction of rotation to prevent heat build-up by the motor 40.

Modifications and variations of the present invention are possible in the light of the above teachings. It is therefore to be understood that, within the scope of the appended claims, the invention may be practiced otherwise specifically described.

Having thus described the invention, what is claimed as novel and desired to secure by Letters Patent is:

1. A thermal printer including a thermal print head, a platen, a carrier moveable bisectionally parallel to the platen, and a thermal print head control mechanism being operable for selectively moving the thermal print head against the platen for printing and away from the platen thereafter, said thermal print head control mechanism comprising:

a bellcrank having first and second arms which rotate about a pivot intermediate said arms, said first bellcrank arm opposite said platen carrying the thermal print head whereby movement of said fist bellcrank arm in a first direction will move said thermal print head toward said platen for printing, and movement of said first bellcrank arm in a second direction will move said thermal print head away from said platen;

a rotary member supported on said carrier for rotary movement about a center of rotation, said rotary member having means thereon for contacting and moving said bellcrank for moving said first bellcrank arm in said first and second directions when said rotary member is rotated; and a spring means for selectively rotating said rotary member, said spring means having a longitudinal axis which is attached at one end to said bellcrank and at the other end to said rotary member, said longitudinal axis of said spring means passing over the center of rotation of said rotary member as said rotary member rotates.

2. A thermal printer according to claim 1 wherein the spring means biases said rotary member against said second bellcrank arm.

3. A thermal printer according to claim 1 including a stepper motor for selectively rotating said rotary member.

4. A thermal printer according to claim 1 wherein said means on said rotary member for contacting and moving said bellcrank in said first and second directions is a cam surface.

5. A thermal printer according to claim 1 wherein said rotary member is a sector gear having peripheral teeth thereon and one side edge.

6. A thermal printer according to claim 1 wherein said spring means is a coil spring.

7. A thermal printer according to claim 6 wherein said coil spring is attached proximate said one side edge of said sector gear.

8. A thermal printer according to claim 7 further including limit means for limiting the rotary movement of said sector gear at limit positions in either direction.

9. A thermal printer according to claim 8 wherein said coil spring biases said sector gear to remain at one of said limit positions.

10. A thermal printer according to claim 9 wherein said limit means include abutments for contact with said sector gear.

11. A thermal printer according to claim 10 wherein said longitudinal axis of said coil spring moves over the center of rotation of said sector gear when said sector gear is selectively rotated between said limit positions to cause rotation of said sector gear to said limit positions.

12. A thermal printer according to claim 8 wherein said coil spring biases said sector gear to remain at said limit positions in either direction.

13. A thermal printer including a thermal print head, a platen, a carrier moveable bisectionally parallel to the platen, and a thermal print head control mechanism being operable for selectively moving the thermal print head against the platen for printing and away from the platen thereafter, said thermal print head control mechanism comprising:

a bellcrank having first and second arms which rotate about a pivot intermediate said arms, said first bellcrank arm opposite said platen carrying the thermal print head whereby movement of said first bellcrank arm in a first direction will move said thermal print head toward said platen for printing, and movement of said first bellcrank arm in a second direction will move said thermal print head away from said platen;

a rotary member supported on said carrier for rotary movement about a center of rotation, said rotary member having means thereon for contacting and moving said bellcrank for moving said first bellcrank arm in said first and second directions for a substantial portion of the movement of said bellcrank when said rotary member is rotated; a spring means for selectively rotating said rotary member, said spring means having a longitudinal axis which is attached at one end to said bellcrank and at the other end to said rotary member, said longitudinal axis of said spring means passing over the center of rotation of said rotary member as said rotary member rotates; and rotary driving means for selectively rotating said rotary member.

14. A thermal printer according to claim 13 further comprising spring means for selectivley rotating said rotary member for moving said bellcrank an additional portion in at least one of said first and second directions.

15. A thermal printer according to claim 13 further comprising spring means for selectivley rotating said rotary member for moving said bellcrank an additional portion in said first and second directions.

* * * * *